United States Patent [19]

Beneke et al.

[11] 4,441,994

[45] Apr. 10, 1984

[54] APPARATUS FOR SEPARATING FOREIGN BODIES FROM FIBER TUFTS

[75] Inventors: Wolfgang Beneke, Monchen-Gladbach; Ferdinand Leifeld, Kempen, both of Fed. Rep. of Germany

[73] Assignee: Trützschler GmbH & Co. KG, Mönchen-Gladbach, Fed. Rep. of Germany

[21] Appl. No.: 345,769

[22] Filed: Feb. 4, 1982

[30] Foreign Application Priority Data

Feb. 5, 1981 [DE] Fed. Rep. of Germany ..... 3103844
Mar. 11, 1981 [DE] Fed. Rep. of Germany ..... 3109154

[51] Int. Cl.[3] ..... B07B 3/00

[52] U.S. Cl. ..... 209/139 R; 209/37; 209/143; 55/461

[58] Field of Search ..... 55/461; 209/143, 138, 209/139 R, 250, 20, 21–23, 30, 31, 36, 37; 406/175, 181, 93

[56] References Cited

U.S. PATENT DOCUMENTS

| | | | |
|---|---|---|---|
| 268,305 | 11/1882 | Smith | 209/143 |
| 773,180 | 10/1904 | Anderson | 209/137 |
| 1,312,291 | 8/1919 | Wicker | 209/143 |
| 2,643,769 | 6/1953 | Tanner | 209/143 |
| 2,668,330 | 2/1954 | Gieszl | 209/138 |
| 2,968,400 | 1/1961 | Clute | 209/143 |
| 3,360,125 | 12/1967 | Horsey | 209/131 |
| 3,666,091 | 5/1972 | Ludlum | 209/17 |
| 4,251,356 | 2/1981 | Harte | 209/250 |
| 4,344,843 | 8/1982 | Leifeld | 209/250 |

FOREIGN PATENT DOCUMENTS

| | | | |
|---|---|---|---|
| 245654 | 8/1947 | Switzerland | 209/143 |
| 206346 | 11/1923 | United Kingdom | 209/139 R |

*Primary Examiner*—Bernard Nozick
*Attorney, Agent, or Firm*—Spencer & Frank

[57] ABSTRACT

A method and apparatus for separating foreign matter from fiber tufts carried by an air stream in a duct. The duct has a bend for altering the direction of flow therein. Upstream of the bend, the stream in the duct is split into at least two partial streams and the foreign matter is separated from at least one of the partial streams. Subsequently, the partial streams are reunited into a single stream.

13 Claims, 4 Drawing Figures

APPARATUS FOR SEPARATING FOREIGN BODIES FROM FIBER TUFTS

BACKGROUND OF THE INVENTION

This invention relates to an apparatus for separating foreign bodies, such as heavy particles (for example, metal, wood or cardboard fragments) and impurities (for example, stems, shell fragments, or leaf fragments) from cotton fiber tufts conveyed pneumatically by means of an air stream, whose flow direction is altered (deflection of the air stream).

For the preparation of spinning, the pneumatically conveyed cotton tufts have to be freed of foreign bodies such as heavy particles, impurities and the like. If the foreign bodies are separated out of the air stream, a number of difficulties are encountered, particularly if the foreign bodies are withdrawn pneumatically by an air stream.

SUMMARY OF THE INVENTION

It is an object of the invention to provide an an apparatus of the above-outlined type in which the foreign bodies are effectively separated from the conveying air stream while the volume thereof remains the same.

This object and others to become apparent as the specification progresses, are accomplished by the invention, according to which, briefly stated, the conveying air stream which entrains the fiber tufts and the foreign bodies is, prior to its deflection, divided into at least two partial streams and further, the foreign bodies are separated from at least one of the partial streams and thereafter the partial streams are combined to again form a single conveying air stream.

The invention is based on the principle to divide the conveying air stream into partial streams and then to re-combine the partial streams into a single air stream. In this manner, the volume of the conveying air stream and thus the required input for providing such a flow remain constant and also, the air streams are stabilized. The foreign bodies are separated from at least one of the partial air streams. The separation between the fiber tufts and the foreign bodes is effected in essence by gravity and/or inertia, for example, by means of flow deflection (that is, by means of changing the direction of the tuft-carrying air stream). In this manner the foreign bodies are effectively removed from the conveying air stream. By virtue of the fact that the volume of the conveying air stream remains unchanged, dust-laden conveying air is prevented from entering the spinning room or, there is no need to provide a separate filter for cleaning such air stream.

The apparatus according to the invention has, in the region where the conduit (duct) changes direction, a separating zone which is formed of at least two aerodynamically coupled chambers through which the partial conveying air streams flow. Preferably, the partial air streams flow through the chambers in a horizontal or oblique orientation so that the foreign bodies may drop off by gravity in a simple manner.

Expediently, underneath the chambers through which the partial air streams flow, a container is arranged for collecting the foreign bodies. The latter drop off the partial streams and may be continuously or periodically removed from the bottom of the container. The partial streams from which foreign bodies are removed in the above-outlined manner, leave the separating chambers and again combine in the duct to form a single fiber tuft-carrying air stream.

The apparatus according to the invention may be advantageously connected in the pipe system of a cleaning line downstream of a bale opener or a waste hopper feeder.

DESCRIPTION OF THE PREFERRED EMBODIMENTS

Figure 1:
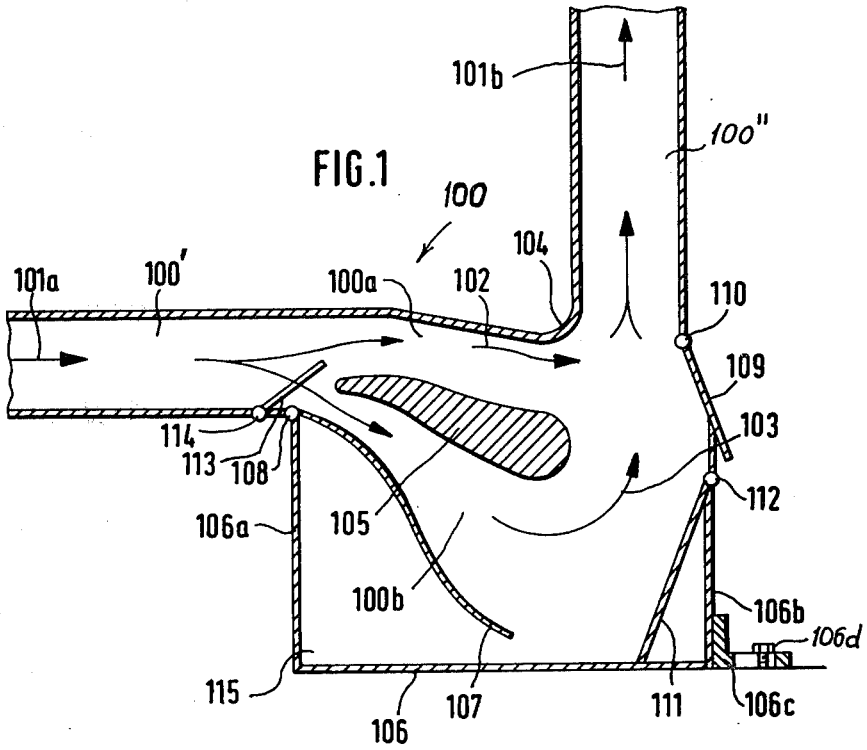
FIG. 1 is a schematic sectional side elevational view of a preferred embodiment of the invention.

Turning now to FIG. 1, there is shown a duct generally indicated at 100 through which fiber tufts are pneumatically conveyed. The duct 100 has a horizontal portion 100' which, with an elbow-like bend 104, changes into a vertical portion 100''. A conveying air stream 101*a* flows in the duct portion 100' in a horizontal orientation, then, at the elbow 104 it changes direction and proceeds vertically upwardly as a conveying air stream 101*b*.

Figure 2:
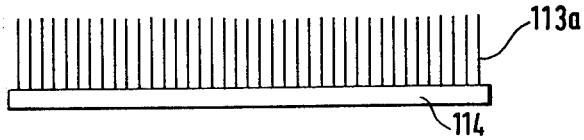
FIG. 2 is schematic top plan view of a component shown in FIG. 1.

In the area of the bend 104 of the duct 100 there is provided a separating zone in which separation between the fiber tufts and the foreign bodies is effected essentially by means of gravity and/or inertia. The separating zone has chambers 100*a* and 100*b*. In the separating zone there is provided an aerodynamically formed air splitter 105 which divides the two chambers 100*a* and 100*b* from one another and which expediently is arranged at a slight inclination with respect to the horizontal direction. The air splitter 105 divides the air stream 101*a* into a partial air stream 102 (flowing in chamber 100*a*) and a partial air stream 103 (flowing in chamber 100*b*). Underneath the air splitter 105 the chamber 100*b* is bounded by a guide element 107 which is supported inside a side wall 106*a* of a container 106 by an articulation 108 to be pivotal about a horizontal axis. In the separating zone above a side wall 106*b* of the container 106, opposite the downstream end of the air splitter 105, there is arranged a baffle element 109 (such as a sheet metal flap) which forms an acute angle with the partial air streams 102 and 103. The baffle element 109 is pivotal about a horizontal axis by means of an articulation 110. To the inside of the wall 106*b* there is attached, by means of an articulation 112, a guide element 111 such as a planar or concave (as viewed from the air splitter 105) plate which is rotatable in a vertical plane. Also referring now to FIG. 2, at a short distance upstream of the air splitter 105 there is arranged a comb 113 which is secured to an articulation 114 arranged at a lower wall of the duct 100. The tines 113*a* of the comb 113 which are open on one side and are oriented obliquely in the direction of the air stream, extend across the flow passage area leading to the chamber 100*b*. The comb 113 holds back big foreign bodies in the air stream 101*a*, e.g. pastehulls, woodparticles, and protects the chamber 100*b* against obstruction.

The partial air stream 102 and the partial air stream 103, after having passed through the respective chambers 100*a* and 100*b*, reunite at the downstream end of the air splitter 105 to form the single conveying air stream 101*b* which flows upwardly through the duct portion 100″ of the duct 100.

The guide element 107 is bent preferably in such a manner that the deflection of the partial air stream 103 about the downstream end of the air splitter 105 is enhanced. The guide element 111 too, is arranged obliquely or bent in such a manner as to support such a course of the partial air stream 103. The distance between the wall 106*b* and the downstream end of the air splitter 105 may be adjusted by shifting the wall 106*b* in the horizontal direction after loosening a securing screw 106*d* in a slotted angle member 106*c* to which the wall 106*b* is attached and which, during operation, immobilizes the wall 106*b* relative to the bottom of the container 106.

The foreign bodies carried in the air stream are separated at least from one of the partial air streams 102 or 103. One part of the heavy particles such as metal, wood or cardboard fragments fall downwardly by virture of gravity. The heavy particles dropping from the partial air stream 102 slide in part on the upper face of the air splitter 105 and then fall into the container 106. The heavy particles dropping out of the partial air stream 103 slide in part on the guide element 107 and fall into the container 106. One part of the heavy particles and impurities is entrained by the partial air stream 102 and is, by virtue of inertia, hurled against the baffle element 109 which deflects the particles downwardly into the container 106, while the fiber tufts are entrained upwardly by the air stream 101*b*.

The flow of the partial air stream 102 and the direction of deflection of the foreign bodies are variable by adjusting the oblique position of the baffle element 109 by rotating it about its articulation 110. The flow of the partial air stream 103 and the sliding direction of the foreign bodies may be altered by adjusting the oblique position of the guide element 107 by rotating it about is articulation 108 or by changing its curvature. The flow of the partial air stream 103 is furthermore variable by adjusting the oblique position of the guide element 111. In this manner, the fiber tufts which arrive in the lower zone of the container 106 are entrained by the partial air stream 103 moving upwardly towards the downstream end of the air splitter 105 and are thus admitted to the air stream 101*b*. The tuft-containing air stream 101*b* is drawn by a condenser or fan (not shown). Between the guide element 107 and the wall 106*a* or, as the case may be, the bottom of the container 106 an aerodynamically "quiet" zone is provided.

Figure 3:
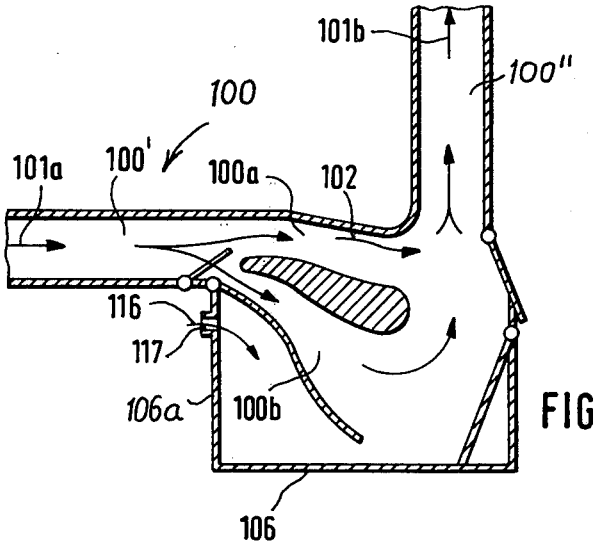
FIGS. 3 and 4 are schematic sectional side elevational views of two further preferred embodiments of the invention.

Turning now to the embodiment illustrated in FIG. 3, the latter differs from the embodiment shown in FIG. 1 essentially in that in the container wall 106*a* there is provided an opening 117 in the wall 106 of the container for introducing a fresh air stream 116.

Figure 4:
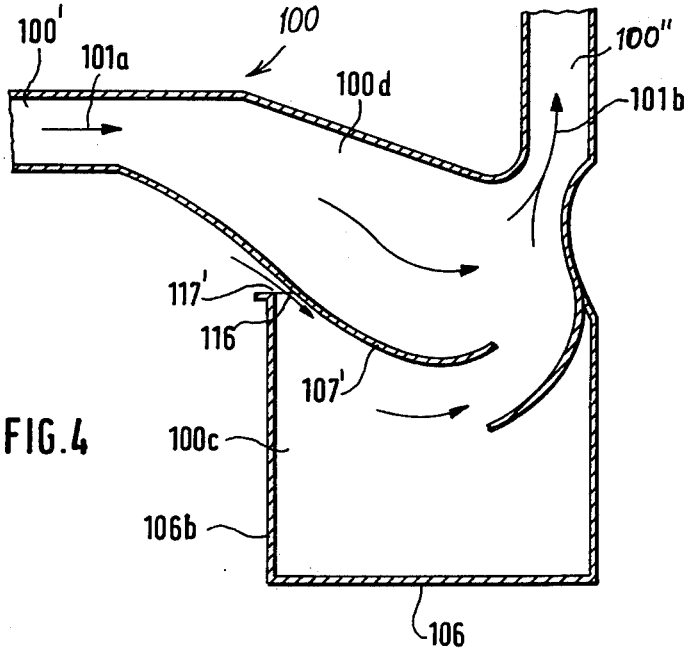

Turning now to FIG. 4, in the embodiment shown therein, in the area of the bend of the duct 100 there is provided a separating zone which comprises at least two aerodynamically coupled chambers 100*c* and 100*d*. The carrier air stream 101*a* flows through the chamber 100*d*, whereas a fresh air stream 116, entering through an opening 117′, flows through the chamber 100*c*. The two air streams are combined into a carrier air stream 101*b*. The guide element 107′ guides the air streams 101*a* and 116 in the direction of the duct outlet. The fresh air stream 116 enters through an opening 117 provided in the wall 106*a* of the container 106.

It will be understood that the above description of the present invention is susceptible to various changes, modifications and adaptations, and the same are intended to be comprehended within the meaning and range of equivalents of the appended claims.

What is claimed is:

1. An apparatus for separating heavy foreign particles from fiber tufts comprising (a) a duct for conveying the fiber tufts by an air stream; said duct having a first, inlet duct portion oriented in a first direction and carrying the fiber tufts and heavy foreign particles to be separated from the fiber tufts; and a second, outlet duct portion arranged downstream of said first duct portion as viewed in the direction of fiber tuft flow therein; said second duct portion being oriented in a second direction different from said first direction;

(b) a separating chamber situated in said duct between said first and second duct portions;

(c) a guide element extending from a downstream end of said first duct portion as a smooth continuation thereof and bounding said separating chamber; said guide element being oriented downwardly for guiding therealong the heavy foreign particles; said guide element having a lower terminal portion curving towards said second duct portion for guiding said air stream into said second direction; said lower terminal portion having a free lower end from which the heavy foreign particles drop out of the separating chamber; and (d) an air splitter in said separating chamber and being spaced from said guide element; said air splitter guiding one part of the air stream into said separating chamber on one side of the air spliter and guiding another part of the air stream towards said second duct portion on the other side of the air spliter.

2. An apparatus as defined in claim 1, further comprising an articulation mounting said guide element to said duct for a pivotal motion in a vertical plane.

3. An apparatus as defined in claim 1, wherein said guide element has an aerodynamic shape.

4. An apparatus as defined in claim 1, wherein said guide element is a first guide element; further comprising a second guide element situated in said separating chamber at a distance from said first guide element; said second guide element being spaced downstream of said first guide element as viewed in the direction of air flow in said separating chamber.

5. An apparatus as defined in claim 1, further comprising inlet means for introducing fresh air into said separating chamber.

6. An apparatus as defined in claim 1, wherein said first direction is substantially horizontal and said second direction is substantially vertical.

7. An apparatus as defined in claim 6, wherein at said separating chamber defines a flow direction which is at an oblique inclination to the horizontal.

8. An apparatus as defined in claim 1, further comprising a comb supported in said first duct portion and extending transversely thereto.

9. An apparatus as defined in claim 1, wherein said second duct portion has an upstream end; further comprising a baffle element situated adjacent said upstream end; said baffle element being oriented at an acute angle to the flow direction defined in said second duct portion.

10. An apparatus as defined in claim 9, further comprising an articulation mounting said baffle element to said duct for a pivotal motion in a vertical plane.

11. An apparatus for separating heavy foreign particles from fiber tufts comprising (a) a duct for conveying the fiber tufts by an air stream; said duct having a first, inlet duct portion oriented in a first direction and carrying the fiber tufts and heavy foreign particles to be separated from the fiber tufts; and a second, outlet duct portion arranged downstream of said first duct portion as viewed in the direction of fiber tuft flow therein; said second duct portion being oriented in a second direction different from said first direction; said second duct portion having an upstream end;

(b) a separating chamber situated in said duct between said first and second duct portions;

(c) a guide element extending from a downstream end of said first duct portion as a smooth continuation thereof and bounding said separating chamber; said guide element being oriented downwardly for guiding therealong the heavy foreign particles; said guide element having a lower terminal portion curving towards said second duct portion for guiding said air stream into said second direction; said lower terminal portion having a free lower end from which the heavy foreign particles drop out of the separating chamber;

(d) a baffle element situated adjacent said upstream end of said second duct portion; said baffle element being oriented at an acute angle to the flow direction defined in said second duct portion;

(e) a vertical wall situated underneath said baffle element, said vertical wall forming part of a container coupled to said duct; and (f) means permitting a horizontal displacement of said vertical wall.

12. An apparatus as defined in claim 11, further comprising an additional guide element mounted on said vertical wall; said additional guide element being situated in said separating chamber.

13. An apparatus as defined in claim 12, further comprising an articulation mounting said additional guide element to said vertical wall for a pivotal motion in a vertical plane.

* * * * *